US011248881B2

(12) United States Patent
Guedon, II

(10) Patent No.: US 11,248,881 B2
(45) Date of Patent: Feb. 15, 2022

(54) BALLISTIC TARGET SYSTEM

(71) Applicant: Emile Guedon, II, Natchez, MS (US)

(72) Inventor: Emile Guedon, II, Natchez, MS (US)

( * ) Notice: Subject to any disclaimer, the term of this patent is extended or adjusted under 35 U.S.C. 154(b) by 0 days.

(21) Appl. No.: 16/945,076

(22) Filed: Jul. 31, 2020

(65) Prior Publication Data

US 2021/0215465 A1 Jul. 15, 2021

Related U.S. Application Data

(60) Provisional application No. 62/871,747, filed on Jul. 9, 2019.

(51) Int. Cl.
*F41J 7/04* (2006.01)
*F41J 1/10* (2006.01)

(52) U.S. Cl.
CPC ... *F41J 7/04* (2013.01); *F41J 1/10* (2013.01)

(58) Field of Classification Search
CPC ..... F41J 1/00; F41J 1/10; F41J 7/04
See application file for complete search history.

(56) References Cited

U.S. PATENT DOCUMENTS

| | | | | |
|---|---|---|---|---|
| 7,427,069 | B2 | 9/2008 | Bateman et al. | |
| 9,746,291 | B1 | 8/2017 | Crawford | |
| 2013/0106059 | A1* | 5/2013 | Larue | F41J 1/10 273/407 |
| 2013/0328268 | A1* | 12/2013 | Eggiman | F41J 5/205 273/378 |
| 2016/0209182 | A1 | 7/2016 | Sovine et al. | |
| 2018/0120065 | A1 | 5/2018 | Pearcey et al. | |

* cited by examiner

*Primary Examiner* — Laura Davison
(74) *Attorney, Agent, or Firm* — Asgaard Patent Services, LLC; F. Wayne Thompson, Jr.

(57) ABSTRACT

The ballistic target system includes a suspended target plate configured to deflect incoming bullets and is adapted to absorb at least a portion of the force transferred by a bullet to the target plate upon impact. An example ballistic target system comprises: a target plate having a mounting bracket attached thereto; and a target stand from which the target plate is slidably suspended. The target stand comprises: a base adapted to rest on the ground, a post, and a target support bracket from which the target plate is slidably suspended by the mounting bracket. The target support bracket comprises a cap portion secured atop the post and an angled strut member that extends at a downward angle from the cap portion to define an incline. The target plate slides rearward and up the incline of the angled strut member when struck by a projectile.

6 Claims, 7 Drawing Sheets

BALLISTIC TARGET SYSTEM

CROSS REFERENCE TO RELATED APPLICATION

This application claims the benefit of U.S. Provisional Application Ser. No. 62/871,747, which was filed on Jul. 9, 2019, the entirety of which is incorporated herein by reference.

TECHNICAL FIELD

This disclosure relates to implementations of a ballistic target system for use during target practice with firearms.

BACKGROUND

Ballistic targets are routinely used to facilitate target practice with firearms. Reactive ballistic targets made of steel are often used for target practice because they generate audible feedback, and sometime movement, when shot. As such, steel targets are well known in the art. These targets are fabricated from hardened steel so that common copper jacketed-lead core bullets, even those fired at high velocity, are pulverized on impact. But, despite material selection, continued use of a ballistic target for practice will eventually crater and/or deform the strike face of the target plate whereupon subsequent bullets may rebound toward the shooter.

In general, the service life of a ballistic target will vary based on the distance at which the target is shot, steel quality, and the caliber, construction, and velocity of the bullet being fired. High velocity ammunition can more easily penetrate steel targets, meaning that faster bullets regardless of caliber are more likely to damage a steel target. Therefore, a need exists for a new steel target that is adapted to absorb at least a portion of the energy transferred by a bullet to the target plate upon impact, thereby extending the service life of the ballistic target.

Accordingly, it can be seen that needs exist for the ballistic target system disclosed herein. It is to the provision of a ballistic target system configured to address these needs, and others, that the present invention is primarily directed.

SUMMARY OF THE INVENTION

Implementations of a ballistic target system are provided. The ballistic target system includes a suspended target plate configured to deflect incoming bullets and is adapted to absorb at least a portion of the force transferred by a bullet to the target plate upon impact. In this way, the service life of the target plate is extended.

An example ballistic target system comprises: a target plate having a mounting bracket attached thereto; and a target stand from which the target plate is slidably suspended. The target stand comprises: a base adapted to rest on the ground, a post, and a target support bracket from which the target plate is slidably suspended by the mounting bracket. The target support bracket comprises a cap portion secured atop the post and an angled strut member that extends at a downward angle from the cap portion to define an incline. The ballistic target system is configured so that the target plate slides rearward and up the incline of the angled strut member when struck by a projectile.

Another example ballistic target system comprises: a target plate having a mounting bracket attached thereto; and a target stand from which the target plate is slidably suspended. The mounting bracket attached to the target plate includes a mounting arm that has a longitudinally extending slot therein. The target stand comprises: a base adapted to rest on the ground, a post, and a target support bracket from which the target plate is slidably suspended by the mounting bracket. The target support bracket comprises a cap portion secured atop the post and an angled strut member that extends at a downward angle from the cap portion to define an incline. The angled strut member includes a protrusion extending upwardly therefrom. The protrusion is configured to be slidably received within the longitudinally extending slot of the mounting bracket attached to the target plate. The ballistic target system is configured so that the target plate slides rearward and up the incline of the angled strut member when struck by a projectile.

BRIEF DESCRIPTION OF THE DRAWINGS

Like reference numerals refer to corresponding parts throughout the several views of the drawings.

DETAILED DESCRIPTION

Figure 1:
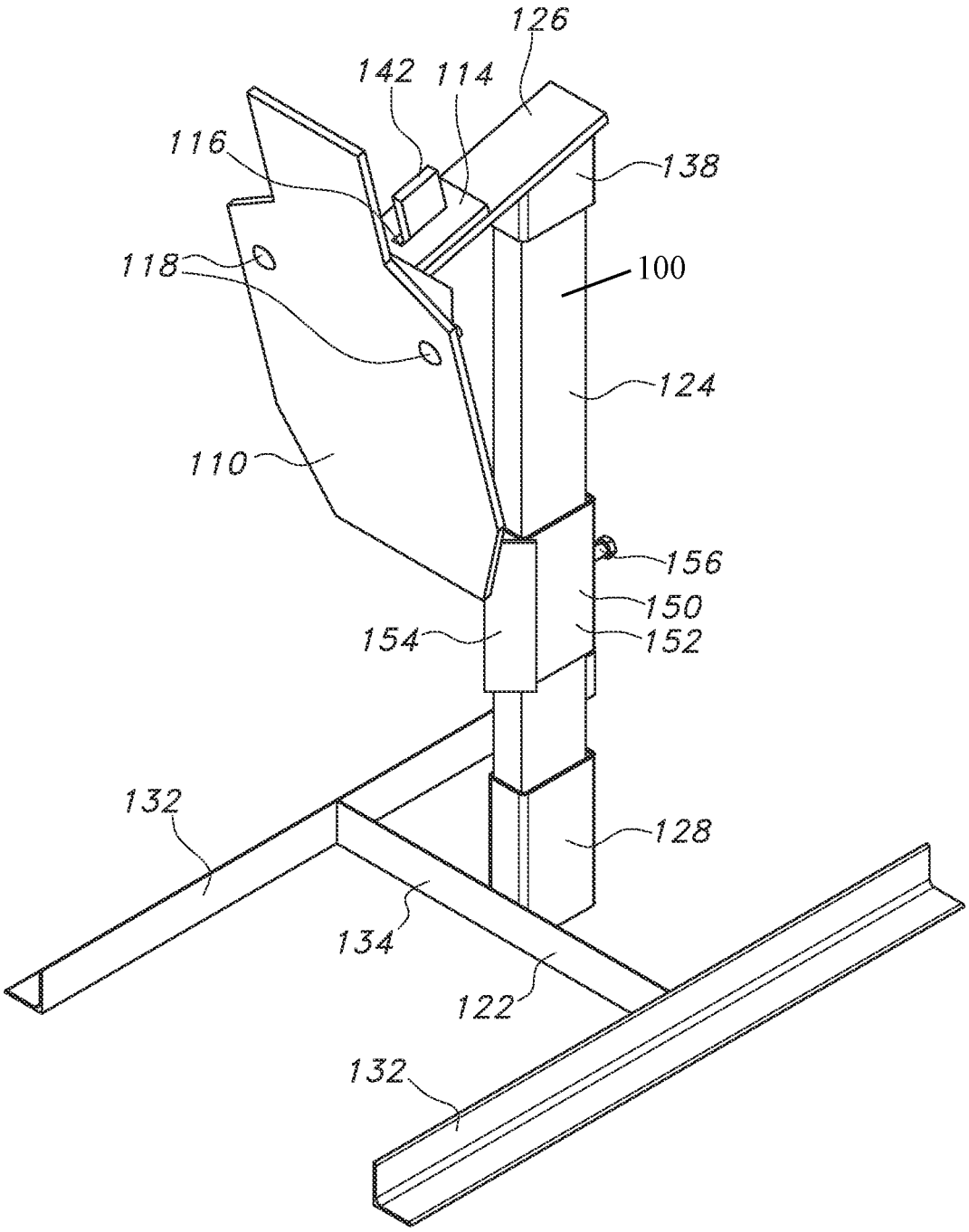
FIG. 1 illustrates isometric views of an exemplary ballistic target system according to the principles of the present disclosure.

FIGS. 1-4 illustrate an example ballistic target system 100 according to the principles of the present disclosure. The ballistic target system 100 includes a suspended target plate 110 configured to deflect incoming projectiles (i.e., bullets) and is adapted to absorb at least a portion of the force transferred by a bullet to the target plate 110 upon impact. In this way, the service life of the target plate 110 is extended.

FIGS. 1-4 illustrates an example ballistic target system 100 comprising: a target plate 110 having a mounting bracket 112 attached thereto; and a target stand 120 from which the target plate is slidably suspended. The target stand 120 comprises a base adapted to rest on the ground, a post 124, and a target support bracket 126 from which the target plate 110 is slidably suspended by the mounting bracket 112 attached thereto. In some implementations, the ballistic target system 100 may further comprise a spall guard 150 configured to protect the post 124 from spall created when a projectile strikes the target plate 110.

The target plate 110 may be any desired shape and will typically be made of hardened steel, such as AR500 or AR550, having a thickness of at least ⅜". In some implementations, the target plate 110 may have a thickness of less than ⅜", for example, if the ballistic target system 100 is intended for use deflecting bullets (e.g., 9 mm) fired from a handgun.

Figure 3:
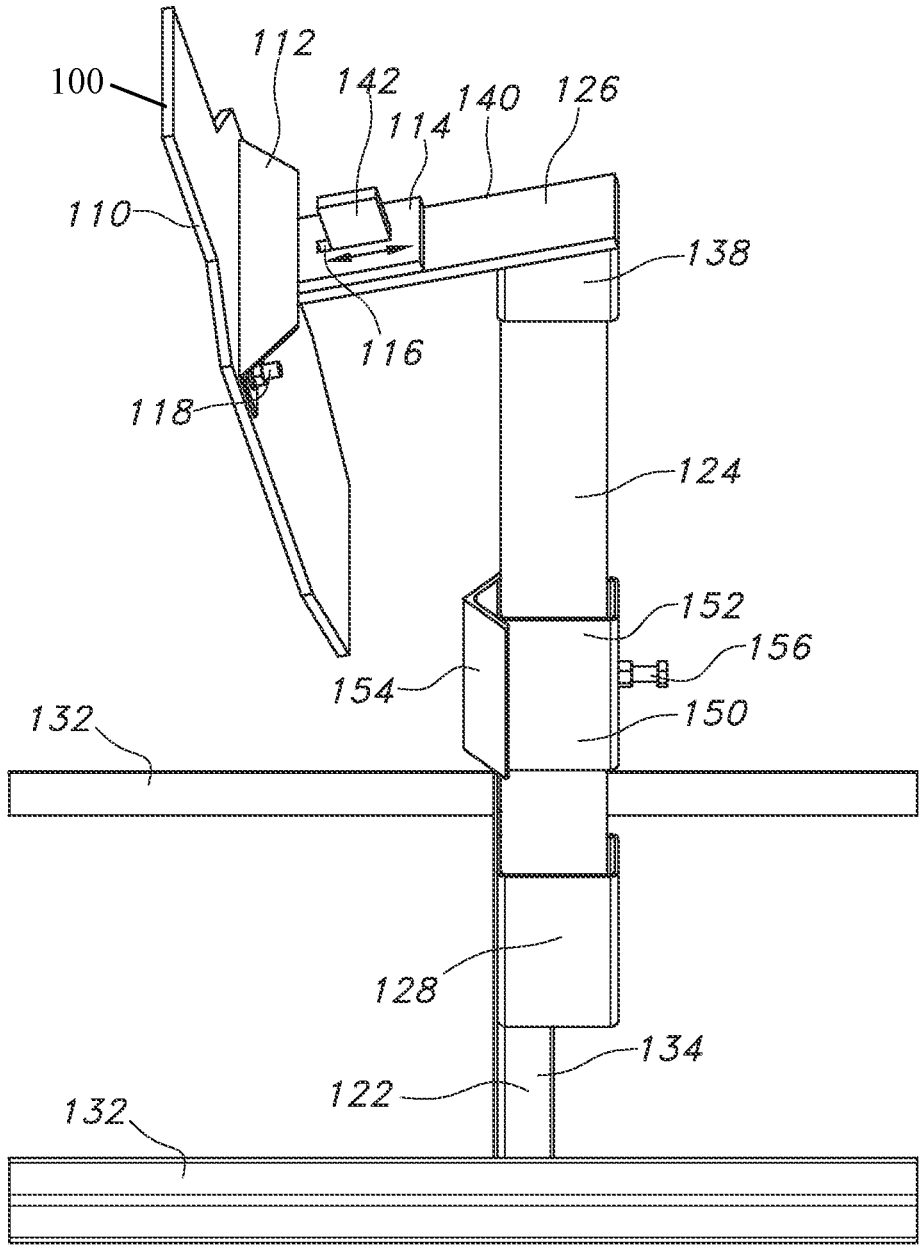
FIG. 3 illustrates another view of the ballistic target system shown in FIG. 1.
Figure 4:
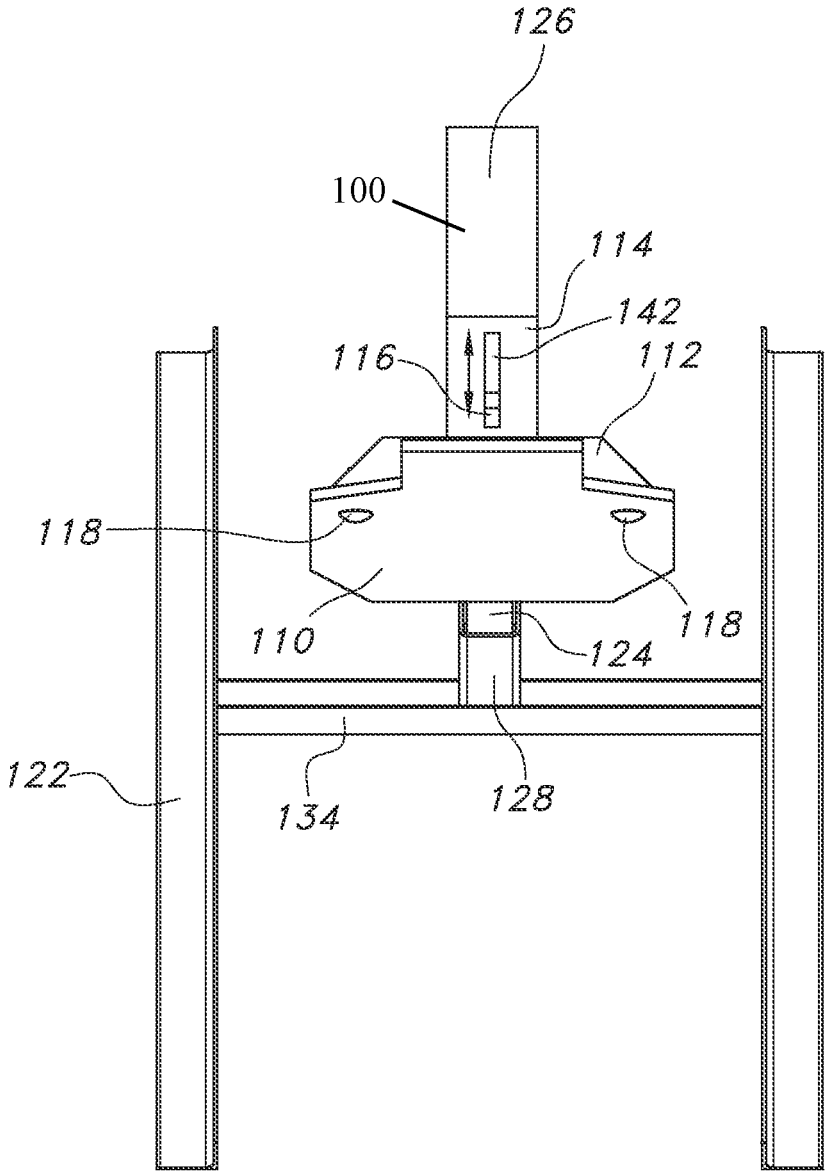
FIG. 4 illustrates yet another view of the ballistic target system shown in FIG. 1.
Figure 5A:
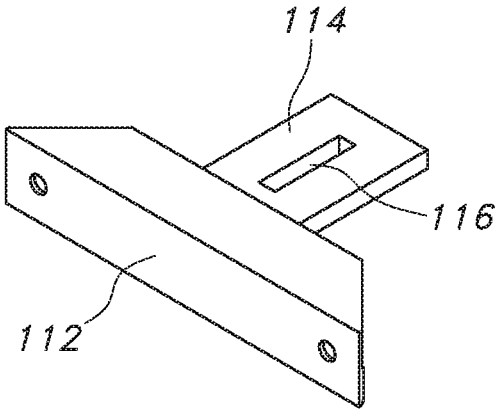
FIG. 5A illustrates an isometric view of an exemplary target bracket of the ballistic target system shown in FIG. 1.
Figure 5C:
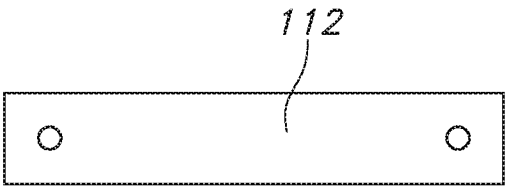
FIG. 5C illustrates a front view of the target bracket shown in FIG. 5A.
Figure 5B:
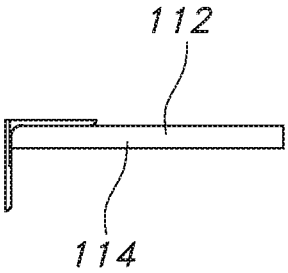
FIG. 5B illustrates a side view of the target bracket shown in FIG. 5A.

As shown best in FIGS. 3 and 4, the mounting bracket 112 is configured to slidably suspend the target plate 110 from the stand 120 of the ballistic target system 100. In some implementations, as shown best in FIG. 5A, the mounting bracket 112 includes a mounting arm 114 that has a longitudinally extending slot 116 therein, the function of which will be discussed below. In some implementations, the mounting bracket 112 may be a length of steel angle stock, having an L-shaped cross-section, from which the mounting arm 114 extends (see, e.g., FIG. 5B).

As shown in FIGS. 3 and 4, in some implementations, the mounting bracket 112 may be fastened to the backside of the target plate 110 by two fasteners 118 (e.g., a pair of lock nuts and carriage bolts). Each carriage bolt extends through an opening in the target plate 110 and the mounting bracket 112, and is secured in position by a lock nut. In this way, a pair of lock nuts and carriage bolts can be used to secure the mounting bracket 112 to the target plate 110. It's possible for the mounting bracket 112 to be removed from one side of the target plate 110 and fastened to the opposite side thereof. In this way, both sides of the target plate 110 can be used (i.e., shot at) before the target plate 110 is discarded and replaced.

Figure 2:
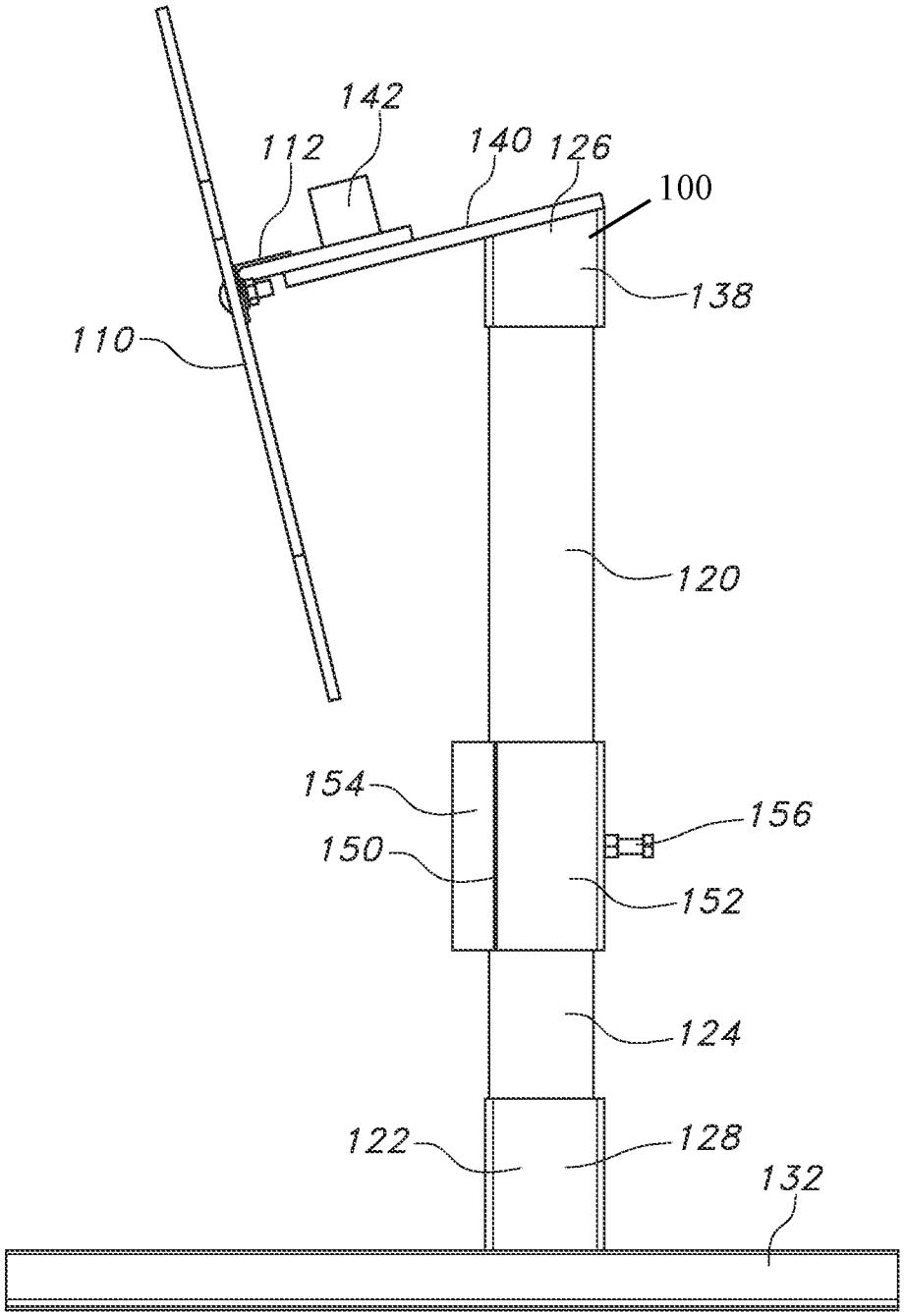
FIG. 2 illustrates a side view of the ballistic target system shown in FIG. 1.

As shown best in FIG. 2, in some implementations, the target stand 120 is configured to position the target plate 110 at an acute angle relative to the ground. Typically, the target plate 110 is held at an angle between 25 and 30 degrees, inclusive of 25° and 30°. The angle of the target plate 110 helps deflect projectiles downwardly after they have impacted the target plate 110.

As shown best in FIGS. 1 and 2, the base 122 of the target stand 120 is adapted to rest on the ground and prevent the target stand 120 from tipping over while supporting the target plate 110. The base 122 is also configured to hold the post 124 in an upright position.

Figure 6:
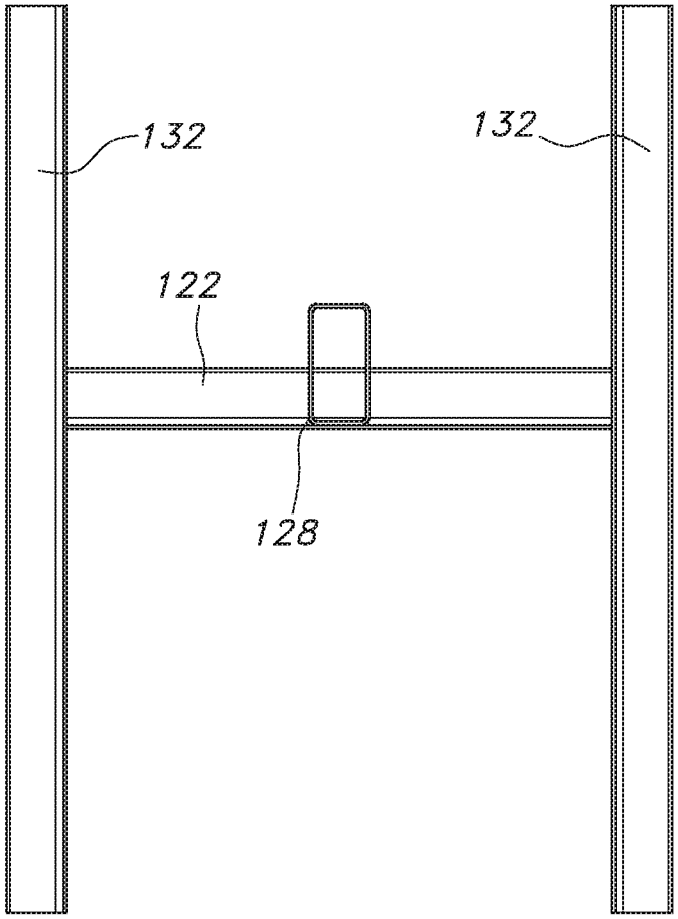
FIG. 6 illustrates a top view of an exemplary base of the ballistic target system shown in FIG. 1.

As shown in FIGS. 1-4, the base 122 of the target stand 120 includes a post socket 128 adapted to receive an end of the post 124 therein. The post socket 128 is adapted to hold the post 124 in an upright position. The base 122 also includes two longitudinally extending feet members 132 connected together by a strut 134 to which the post socket 128 is secured. Due to the arrangement of the strut 134 and the feet members 132, the base 122 of the target stand 120 has an H-shape, in plan view, that contributes to its stability (see, e.g., FIG. 6). The strut 134 may be a length of steel angle stock having an L-shaped cross-section. Attaching the post socket 128 to the L-shaped strut 134 allows for flexion of the post 124 and thereby the target plate 110 connected thereto by the target support bracket 126. In this way, at least a portion of the force transferred by a projectile to the target plate 110 upon impact is absorbed by the ballistic target system 100.

As shown in FIGS. 1-4, the post 124 is oriented so that its bottom end is positioned within the post socket 128 of the target stand 120. The post 124 is made of wood (e.g., a standard two-by-four piece of lumber) so that stray projectiles do not rebound therefrom. It is anticipated that the wood post 124 will need to be replaced from time to time. While the example post 124 is made of wood, in some implementations, a post made of another suitable material (e.g., plastic) could be used.

Figure 7:
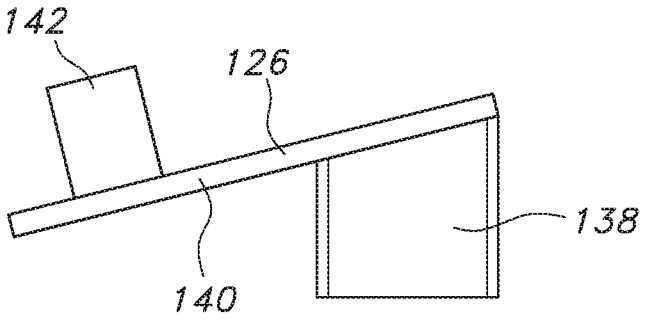
FIG. 7 illustrates a side view of an exemplary target support bracket of the ballistic target system shown in FIG. 1.

As shown in FIGS. 1-3, the target support bracket 126 is secured atop the post 124 and configured so that the target plate 110 can be slidably suspended therefrom. As shown best in FIG. 7, the target support bracket 126 comprises a cap portion 138 configured to fit over the top end of the post 124; and an angled strut member 140 projecting from the cap portion 138. The angled strut member 140 includes a protrusion 142, having a rectangular cross-section, that extends upwardly therefrom. The protrusion 142 of the target support bracket 126 is configured to be slidably received within the longitudinally extending slot 116 of the mounting bracket 112 secured to the target plate 110. In this way, the target plate 110 slides rearwardly and up an incline when struck by a projectile, thereby allowing the junction between the slot 116 of the mounting bracket 112 and the protrusion 142 of the target support bracket 126 to absorb at least a portion of the force imparted by the impacting projectile. Once the force imparted by the projectile's impact has diminished (or dissipated) sufficiently, the target plate 110, under the influence of gravity, slides back down the angled strut member 140 of the target support bracket 126.

While the protrusion 142 of the angled strut member 140 is shown and described as having a rectangular cross-section, it should be understood that the protrusion 142 could be another shape (e.g., a cylindrical peg) that can be slidably received within the slot 116 of the mounting bracket 112.

Figure 8:
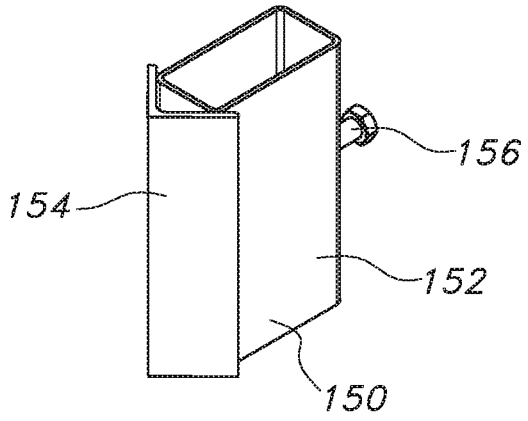
FIG. 8 illustrates an isometric view of an exemplary spall guard of the ballistic target system shown in FIG. 1.

As shown in FIGS. 1 and 2, the spall guard 150 is configured to fit around the post 124 of the target stand 120. In some implementations, as shown in FIG. 8, the spall guard 150 comprises a tubular body 152 and a deflection member 154. The tubular body portion 152 of the spall guard 150 defines an opening therethrough that is configured to fit about the post 124 of the target stand 120. The deflection member 154 is attached to a front side of the tubular body 152 and configured to deflect spall originating from the target plate 110 to the sides of the post 124. In this way, the service life of the post 124 may be extended. In some implementations, the deflection member 154 of the spall guard 150 is a length of steel angle stock, having an L-shaped cross-section. The apex of the steel angle stock is pointing away from the body portion 152 of the spall guard 150 (see, e.g., FIG. 8). In this way, spall is deflected to the sides of the post 124.

As shown in FIGS. 1-3, the spall guard 150 is held in position on the post 124 of the target stand 120 by a fastener 156 (e.g., a bolt). In some implementations, the fastener 156 is threadedly received by an opening in the backside of the spall guard 150 and presses against the post 124 (see, e.g., FIG. 2). When tightened into position, the tip of the fastener 156 presses against the post 124 and thereby secures the spall guard 150 in place. In some implementations, not shown, the spall guard 150 may be secured to the post 124 by two or more fasteners. While the example fastener 156 shown in the illustrations is a bolt, it should be understood that, in some implementations, another fastener such as a screw, nail, or the like could be used to secure the spall guard 150 to the post 124.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A ballistic target system comprising:

a target plate configured to deflect bullets, the target plate having a mounting bracket attached thereto; and a target stand from which the target plate is slidably suspended, the target stand comprises a base adapted to rest on the ground, a post, and a target support bracket from which the target plate is slidably suspended by the mounting bracket, the target support bracket comprises a cap portion secured atop the post and an angled strut member that extends at a downward angle from the cap portion to define an incline;

wherein the ballistic target system is configured so that the target plate slides rearward and up the incline of the angled strut member when struck by a projectile.

2. The ballistic target system of claim 1, further comprising a spall guard configured to protect the post from spall created when a bullet impacts the target plate.

3. The ballistic target system of claim 1, wherein the base of the target stand includes a post socket and a strut to which the post socket is secured, the post socket is adapted to receive an end of the post therein and the strut is adapted to facilitate flexion of the post socket, and by extension, the post secured therein when the target plate is struck by a bullet.

4. A ballistic target system comprising:

a target plate configured to deflect bullets, the target plate having a mounting bracket attached thereto, the mounting bracket includes a mounting arm that has a longitudinally extending slot therein; and a target stand from which the target plate is slidably suspended, the target stand comprises a base adapted to rest on the ground, a post, and a target support bracket from which the target plate is slidably suspended by the mounting bracket, the target support bracket comprises a cap portion secured atop the post and an angled strut member that extends at a downward angle from the cap portion to define an incline, the angled strut member includes a protrusion extending upwardly therefrom;

wherein the protrusion of the target support bracket is configured to be slidably received within the longitudinally extending slot of the mounting bracket attached to the target plate;

wherein the ballistic target system is configured so that the target plate slides rearward and up the incline of the angled strut member when struck by a projectile.

5. The ballistic target system of claim 4, further comprising a spall guard configured to protect the post from spall created when a bullet impacts the target plate.

6. The ballistic target system of claim 4, wherein the base of the target stand includes a post socket and a strut to which the post socket is secured, the post socket is adapted to receive an end of the post therein and the strut is adapted to facilitate flexion of the post socket, and by extension the post secured therein, when the target plate is struck by a bullet.

* * * * *